US010618138B2

(12) United States Patent
Schwarzwald

(10) Patent No.: US 10,618,138 B2
(45) Date of Patent: Apr. 14, 2020

(54) BELT SHARPENER

(71) Applicant: Sergio Schwarzwald, Rehovot (IL)

(72) Inventor: Sergio Schwarzwald, Rehovot (IL)

( * ) Notice: Subject to any disclaimer, the term of this patent is extended or adjusted under 35 U.S.C. 154(b) by 50 days.

(21) Appl. No.: 15/907,782

(22) Filed: Feb. 28, 2018

(65) Prior Publication Data

US 2019/0262962 A1 Aug. 29, 2019

(51) Int. Cl.
*B24B 3/54* (2006.01)
*B24B 21/12* (2006.01)

(52) U.S. Cl.
CPC ..... *B24B 3/54* (2013.01); *B24B 21/12* (2013.01)

(58) Field of Classification Search
CPC ..... B24B 21/12; B24B 21/14; B24B 29/06; B24B 3/54
USPC ..... 451/45, 296, 311; 76/82, 86, 88
See application file for complete search history.

(56) References Cited

U.S. PATENT DOCUMENTS 2,222,966 A * 11/1940 Williams ..... B24B 21/002 451/296
2,232,149 A * 2/1941 Tautz ..... B24B 21/00 451/296
3,127,712 A * 4/1964 Krogen ..... B24B 21/00 451/311
4,043,082 A * 8/1977 Ferroglio ..... B24B 3/54 451/311
4,091,574 A * 5/1978 Horwitz ..... B24B 3/60 451/303
4,204,371 A * 5/1980 Horwitz ..... B24B 3/60 451/303
4,316,349 A * 2/1982 Nelson ..... B24B 21/00 451/296
4,964,241 A * 10/1990 Conklin ..... B24B 3/36 451/241
6,071,183 A * 6/2000 Havins ..... B24B 3/60 451/296
6,663,475 B2 * 12/2003 Price ..... B24B 21/14 198/814
7,374,470 B2 * 5/2008 Fuchs ..... B24B 3/54 451/297
7,387,562 B1 * 6/2008 Blum ..... B24D 15/08 451/380
8,696,407 B2 * 4/2014 Dovel ..... B24B 3/52 451/45
8,784,162 B1 * 7/2014 Dovel ..... B24B 3/54 451/303
9,333,612 B2 * 5/2016 Dovel ..... B24B 3/36
9,914,193 B2 * 3/2018 Dovel ..... B24B 21/20
2005/0287934 A1 * 12/2005 Jansson ..... B24B 3/52 451/45
2017/0232569 A1 * 8/2017 Dovel ..... B24B 3/54 451/45
2018/0200856 A1 * 7/2018 Dovel ..... B24B 3/54

* cited by examiner

*Primary Examiner* — Michael C McCullough

(57) ABSTRACT

A belt sharpener comprises a drive pulley, a belt tensioner, a contact roller, an idler pulley and an endless abrasive belt mounted for rotation between them. The belt sharpener also includes a primary and a secondary guides adapted to hold a blade at a desired angle with respect to the abrasive belt.

3 Claims, 3 Drawing Sheets

BELT SHARPENER

BACKGROUND OF THE INVENTION

Technical Field

The present invention relates to the field of knife sharpeners. More specifically, the invention relates to belt sharpeners.

Description of the Related Art

Cutting tools are used in a variety of applications to cut or otherwise remove material from a workpiece. A variety of cutting tools are well known in the art, including but not limited to knives, scissors, shears, blades, chisels, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as conventional kitchen knives, the opposing surfaces are generally symmetric; other cutting tools, such as scissors, have a first opposing surface that extends in a substantially normal direction, and a second opposing surface that is skewed with respect to the first surface. More complex geometries can also be used, such as multiple sets of bevels at different respective angles that taper to the cutting edge.

Cutting tools can become dull over time after extended use, and thus it can be desirable to subject a dulled cutting tool to a sharpening operation to restore the cutting edge to a greater level of sharpness.

In the following detailed description of the invention, numerous specific details are set forth in order to provide a thorough understanding of the invention. However, it will be obvious to one skilled in the art that the invention may be used without these specific details. In other instances well-known procedures, components, and elements are not described here in detail so as not to unnecessarily obscure aspects of the invention. It will be readily understood that the components of the present invention, as generally described and illustrated in the figures, may be arranged and designed in a wide variety of different configurations. Thus, the following more detailed description of the embodiments of the devices and methods of the present invention, as represented in the figures, is not intended to limit the scope of the invention, but is merely representative of selected embodiments of the invention.

SUMMARY OF THE INVENTION

A belt sharpener of the present invention includes a drive pulley, a belt tensioner, a contact roller with an outer layer made of elastically deformable material and an idler pulley attached to a frame. The belt sharpener also includes an endless abrasive belt mounted for rotation between the drive pulley, belt tensioner, contact roller and the idler pulley. The belt sharpener further comprises a primary and secondary guide adapted to hold a blade at a desired angle towards the abrasive belt. The angle of the primary and secondary guide is set independently by using two different angle selectors. In case of mechanically connected primary and secondary guide, the angle for both of them is set by a single angle selector.

BRIEF DESCRIPTION OF THE DRAWINGS

Additional advantages and features of the invention are revealed in the claims and the following description of a preferred exemplary embodiments of the invention that is explained with reference to the drawings, in which:

DETAILED DESCRIPTION OF THE INVENTION

Figure 1:
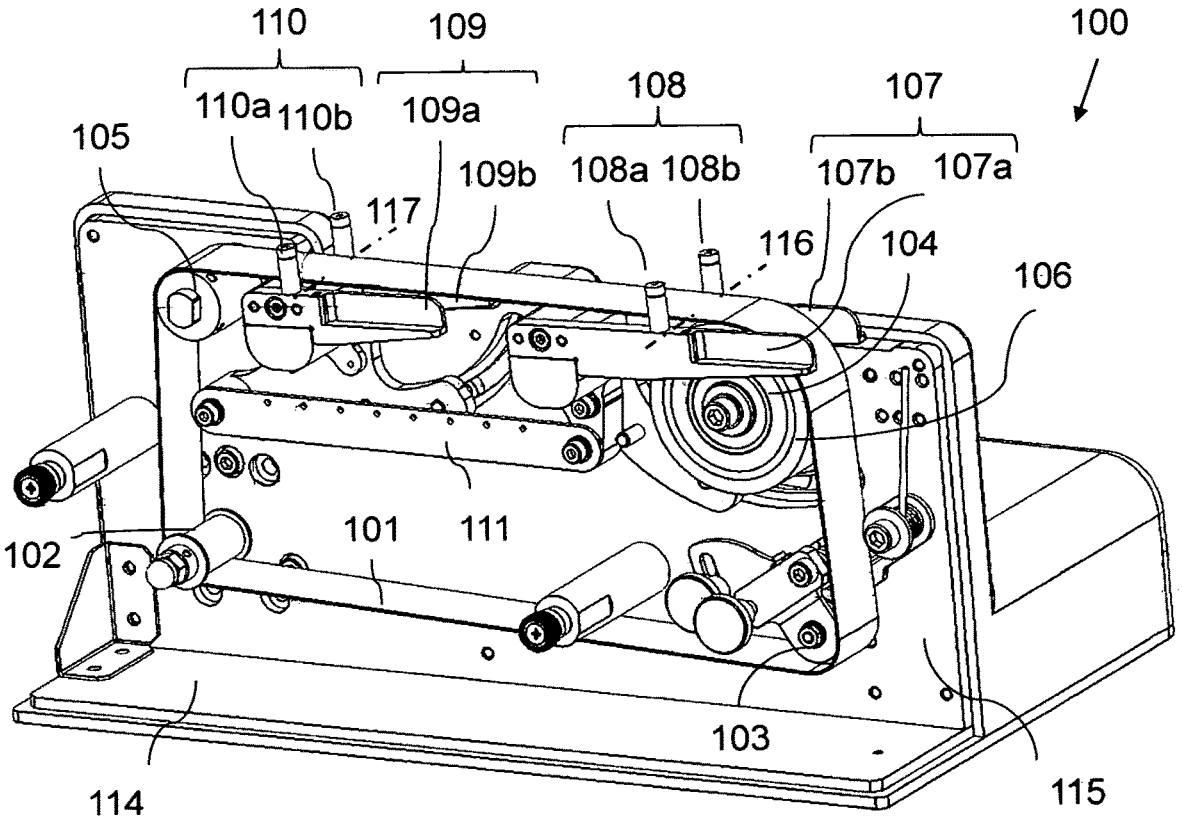
FIG. 1 is a perspective view of a belt sharpener according to an embodiment of the present invention.
Figure 2:
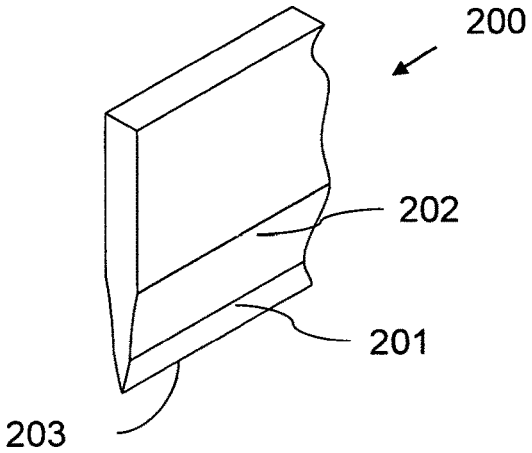
FIG. 2 is a section view of a blade sharpened by the belt sharpener of the present invention.
Figure 3:
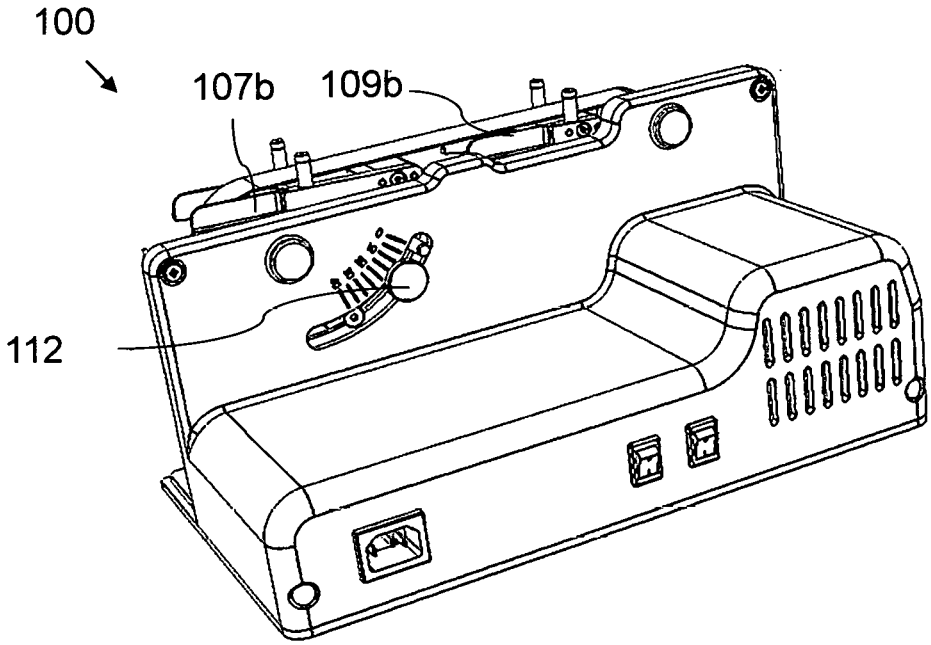
FIG. 3 is another perspective view of a belt sharpener according to an embodiment of the present invention.
Figure 4:
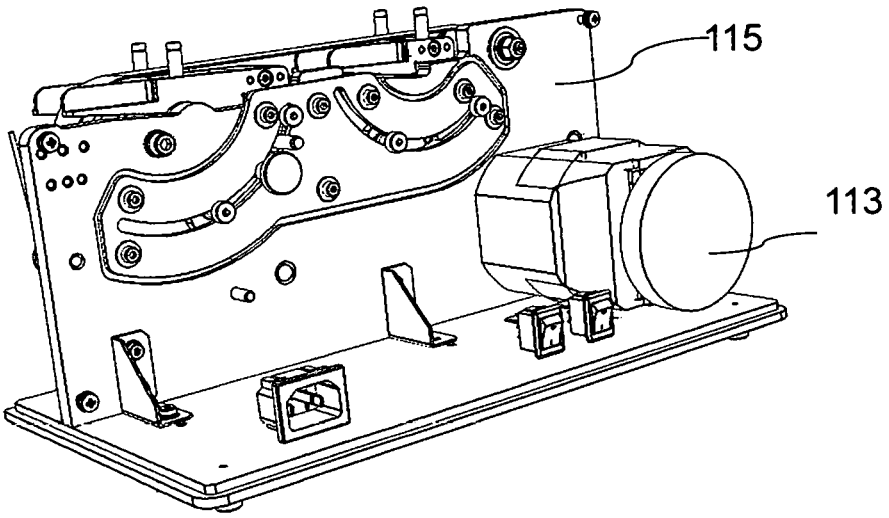
FIG. 4 is yet another perspective view of a belt sharpener according to an embodiment of the present invention.

FIG. 1, FIG. 3, and FIG. 4 show a belt sharpener 100 constructed in accordance with an embodiment of the present invention. The belt sharpener 100 includes a base 114 and a vertical frame 115 attached to the base 114. The belt sharpener 100 further comprises a drive pulley 102, a belt tensioner 103, a contact roller 104, an idler pulley 105 and an endless abrasive belt 101 mounted for rotation between them. The drive pulley 102, belt tensioner 103, contact roller 104 and idler pulley 105 are attached to the frame 115.

The drive pulley 102 is connected to an electric motor 113 and is responsible for the continuous movement of the abrasive belt 101. The contact roller 104 includes an outer layer 106 that coats the contact roller 104. The layer 106 is made of a suitable natural or synthetic material that can be elastically deformed when pressed by an external force (for example spongy or rubbery material).

The belt sharpener 100 also includes a primary blade guide 107 with a primary blade stop 108 and a secondary blade guide 109 with a secondary blade stop 110.

The primary guide 107 are comprised of a left primary guide 107*a* located to the left of the abrasive belt 101 and the contact roller 104, and a right primary guide 107*b* located to the right of the abrasive belt 101 and the contact roller 104. The primary blade guide 107 are adapted to move around a primary axis 116 which is parallel to and located below the surface of the abrasive belt 101, and perpendicular to the direction of the motion of the abrasive belt 101.

The primary blade stop 108 is comprised of a left primary post 108*a* attached to the left primary guide 107*a*, near the primary axis 116, and a right primary post 108*b* attached to the right primary guide 107*b*, near the primary axis 116.

The secondary guide 109 are comprised of a left secondary guide 109*a* located to the left of the abrasive belt 101, and a right secondary guide 109*b* located to the right of the abrasive belt 101. The secondary blade guide 109 are adapted to move around a secondary axis 117 which is parallel to and located below the surface of the abrasive belt 101, and perpendicular to the direction of the motion of the abrasive belt 101.

The secondary blade stop 110 is comprised of a left secondary post 110*a* attached to the left secondary guide 109*a*, near the secondary axis 117, and a right secondary post 110*b* attached to the right secondary guide 109*b*, near the secondary axis 117.

The guide 107, 109 are adapted to ensure the desired presentation angle of the blade 200 to the abrasive belt 101. The desired presentation angle of the blade 200 to the abrasive belt 101 may be adjusted by an angle selector 112, connected to the primary blade guide 107, and through a mechanical connector 111 to the secondary blade guide 109. This connection guarantees that the sharpening angle (set by the angle selector 112) remains the same for the primary 107 and for the secondary 109 blade guide.

Figure 5:
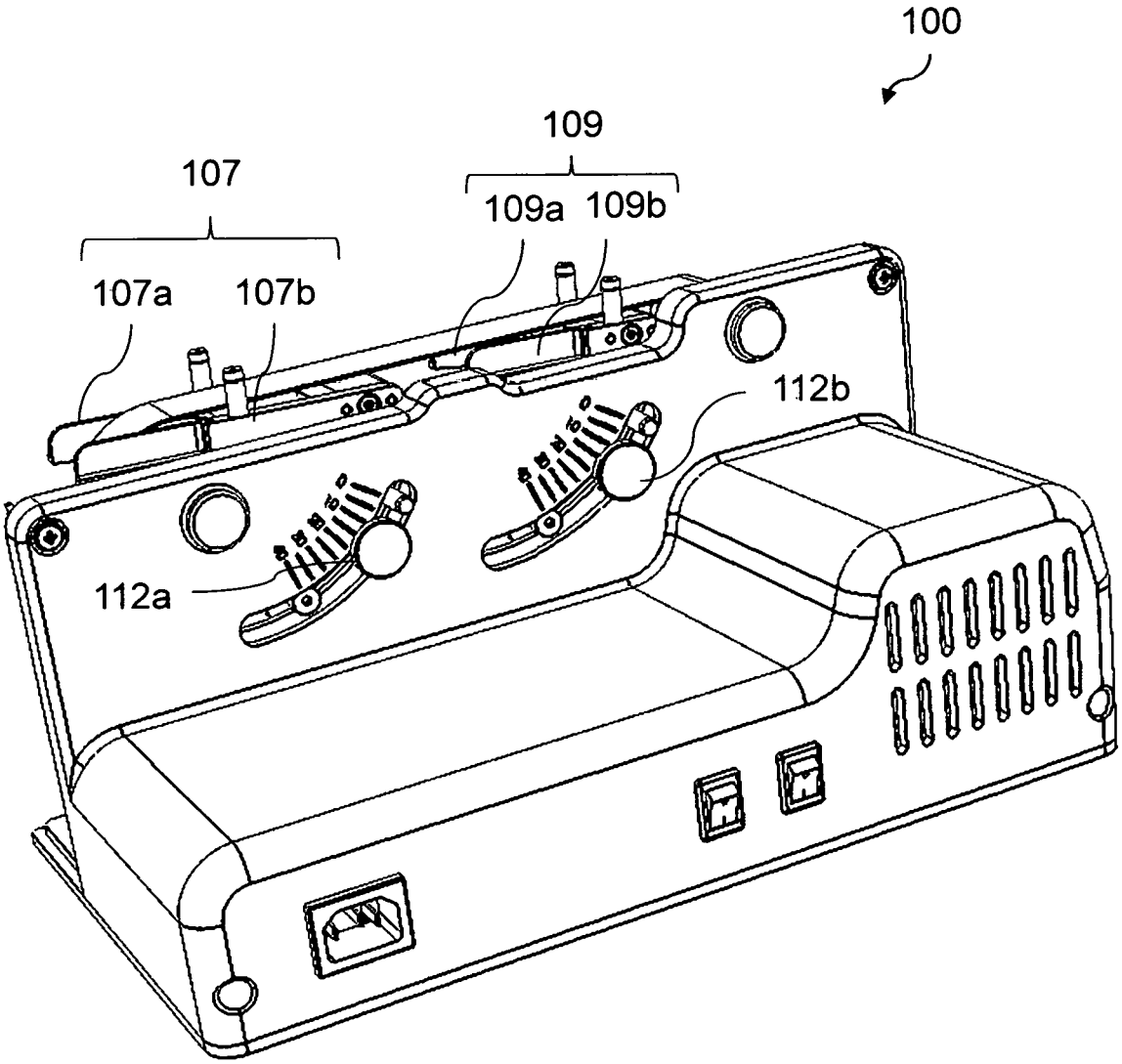
FIG. 5 is a perspective view of a belt sharpener according to another embodiment of the present invention.

Another embodiment of the present invention is depicted in FIG. 5. In this embodiment, the angles of the primary 107 and the secondary 109 guide are adjusted separately, by a primary angle selector 112*a* and a secondary angle selector 112*b* respectively.

During the first phase of the sharpening process, the blade 200 is placed on the primary guide 107 (with the cutting edge 203 superimposed on the primary axis 116), the primary bevel 202 of the blade 200 is pressed against the abrasive belt 101 and the contact roller 104. This pressure creates a local depression in the layer 106, located beneath the belt 101, thus causing the abrasive belt 101 to sharpen the primary bevel 202 to a concave shape.

During the second phase of the sharpening process, the blade 200 is placed on the secondary guide 109 (with the cutting edge 203 superimposed on the secondary axis 117), and the secondary bevel 201 of the blade 200 is pressed against the abrasive belt 101 and sharpened to a convex shape.

The sharpening of the primary bevel 202 provides a leaner form to the blade 200, thus aiding in (by reducing the amount of removed blade material) sharpening of the secondary bevel 201 to a convex shape.

During the sharpening process, the abrasive belt 101 can be changed to different abrasive grits and materials by pressing the belt tensioner 103.

Although different illustrative embodiments have been shown and described, a wide range of modification change and substitution is contemplated in the foregoing disclosure, and in some instances, some features of the embodiments may be employed without a corresponding use of other features. Accordingly, it is appropriate that the appended claims are construed broadly and in a manner consistent with the scope of the embodiments disclosed herein.

What is claimed is:

1. A belt sharpener comprising:

a. a drive pulley, a belt tensioner, a contact roller and an idler pulley attached to a frame; and b. an endless abrasive belt mounted for rotation between the drive pulley, belt tensioner, contact roller and the idler pulley; and wherein said contact roller includes an outer layer made of elastically deformable material; and c. a primary guide adapted to hold a blade, and further adapted to move around a primary axis, thus ensuring the desired presentation angle of the blade to the abrasive belt, and wherein said primary axis located below the abrasive belt, is parallel to the surface of the belt and perpendicular to the direction of the motion of the belt, which comprises a left primary guide located to the left of the abrasive belt and the contact roller, and a right primary guide located to the right of the abrasive belt and the contact roller, said primary guide is connected to a primary angle selector; and d. a secondary guide adapted to hold a blade, and further adapted to move around a secondary axis, thus ensuring the desired presentation angle of the blade to the abrasive belt, and wherein said secondary axis located below the abrasive belt, is parallel to the surface of the belt and perpendicular to the direction of the motion of the belt, which comprises a left secondary guide located to the left of the abrasive belt, and a right secondary guide located to the right of the abrasive belt, said secondary guide is connected to a secondary angle selector, wherein said primary and secondary guides are connected by a mechanical connector.

2. The belt sharpener of claim 1, wherein said elastically deformable material is rubber.

3. The belt sharpener of claim 1, wherein said elastically deformable material is a polyurethane foam.

* * * * *